US007975816B1

(12) United States Patent
Lin

(10) Patent No.: US 7,975,816 B1
(45) Date of Patent: Jul. 12, 2011

(54) PULL-ROD COMPUTER BAG

(75) Inventor: Eiken Lin, Taipei (TW)

(73) Assignee: Alliance Luggage, Inc., Taipei (TW)

( * ) Notice: Subject to any disclaimer, the term of this patent is extended or adjusted under 35 U.S.C. 154(b) by 373 days.

(21) Appl. No.: 12/211,083

(22) Filed: Sep. 15, 2008

(51) Int. Cl.
*A45C 13/26* (2006.01)

(52) U.S. Cl. ..... 190/37; 190/18 A; 190/115; 190/103; 190/124

(58) Field of Classification Search ..... 190/115, 190/18 A, 124, 127, 903, 103, 18 R, 37
See application file for complete search history.

(56) References Cited

U.S. PATENT DOCUMENTS 2,362,807 A * 11/1944 Dresner ..... 206/289
4,940,173 A * 7/1990 Jacober ..... 224/153
5,310,031 A * 5/1994 Plath ..... 190/18 A
6,059,079 A * 5/2000 Krulik ..... 190/112
6,454,066 B1 * 9/2002 Chen ..... 190/115
6,591,950 B1 * 7/2003 Scicluna ..... 190/103
2004/0231942 A1 * 11/2004 Santy et al. ..... 190/125
2006/0011437 A1 * 1/2006 Selvi ..... 190/103
2006/0196743 A1 * 9/2006 Lin ..... 190/18 A
2007/0267262 A1 * 11/2007 Sederoff ..... 190/103
2008/0087513 A1 * 4/2008 Majeau ..... 190/111
2008/0142323 A1 * 6/2008 Chen ..... 190/125

* cited by examiner

*Primary Examiner* — Tri M Mai
(74) *Attorney, Agent, or Firm* — Egbert Law Offices PLLC

(57) ABSTRACT

The present invention provides a pull-rod computer bag including a bag body, internally defining a hold space; a pull rod, assembled scalably onto one side of the hold space; a roller set, assembled at one corner of the bag body; and a housing cover with a computer hold tank. The housing cover is laterally connected with the bag body, enabling opening and closing and having a faceplate and a peripheral portion, such that the computer hold tank is formed between the faceplate and peripheral portion. A buffer pad is assembled on the faceplate and a retractable side wall is assembled onto the peripheral portion of the housing cover, enabling the peripheral portion to be expanded or reduced with respect to the area. A flexible control member is used to locate the shrinking state of the retractable side wall.

5 Claims, 7 Drawing Sheets

PULL-ROD COMPUTER BAG

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to luggage, and more particularly to an innovative bag to accommodate and to carry a notebook computer.

2. Description of Related Art Including Information Disclosed Under 37 CFR 1.97 and 37 CFR 1.98

With the progress of science and technology and the overflow of information, more and more people choose to carry notebook computers during travels or negotiations, thus gaining easier access to information conducive to dealing with electronic affairs or business negotiations. In response to this requirement, a "pull-rod computer bag" is developed in this industry. It is characterized in that, its inner space is exclusively designed for accommodating a notebook computer. Some relevant accessories are also arranged for placing the files or meeting relevant requirements of the users.

When going abroad with the pull-rod computer bag, the users are often required by the inspectors of airports and ports to open the bag and take out the notebook computer to identify clearly if any contraband is contained therein. Yet, since the notebook computer is a precision electronic product, severe impact or vibration may lead to its malfunction or even damage. But, during time-pressing customs clearance process, the notebook computer may slip out of the user's hands or be placed by a strong force, leading to mechanical loss or damage.

Thus, to overcome the aforementioned problems of the prior art, it would be an advancement in the art to provide an improved structure that can significantly improve efficacy.

Therefore, the inventor has provided the present invention of practicability after deliberate design and evaluation based on years of experience in the production, development and design of related products.

BRIEF SUMMARY OF THE INVENTION

Based on the unique present invention, the faceplate of the housing cover is provided with a buffer pad, and the peripheral portion of the housing cover is provided with a retractable side wall and a flexible control member. The pull-rod computer bag allows the user to open directly the housing cover and expose the notebook computer during the process of customs clearance. The faceplate of the housing cover is made of a non-metal structure and can be placed horizontally with a shock-proof effect. The invention complies with the provisions of airport security and customs while protecting the notebook computer against any damage.

Based on the structures of the present invention, an intermediate storage bag between the housing cover and bag body is circled and supported by a solid frame. A better accommodation function could be realized through this robust intermediate storage bag to meet the actual demands of the users.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

The features and the advantages of the present invention will be more readily understood upon a thoughtful deliberation of the following detailed description of a preferred embodiment of the present invention with reference to the accompanying drawings.

Figure 1:
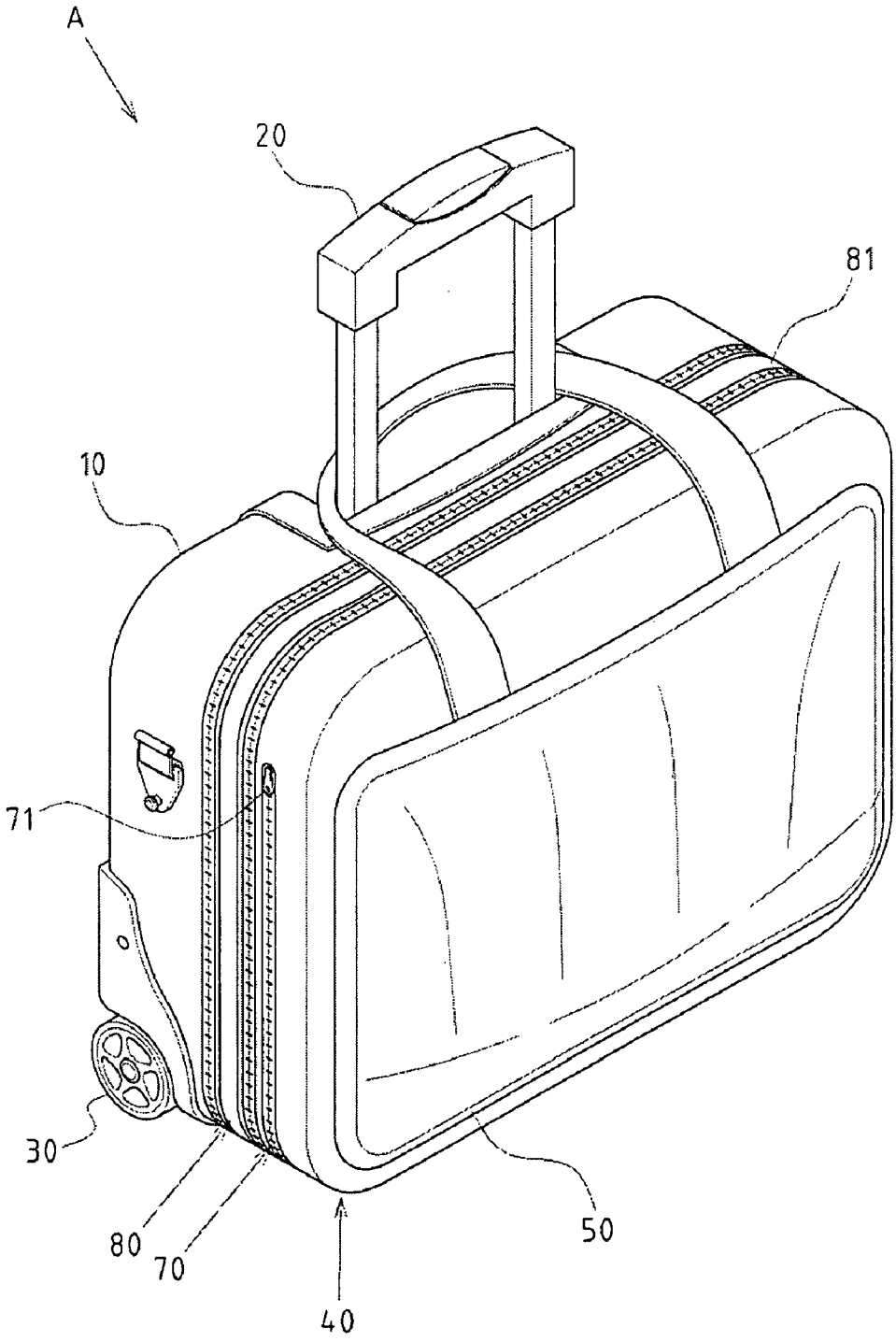
FIG. 1 is a perspective view of the pull-rod computer bag of the present invention.
Figure 2:
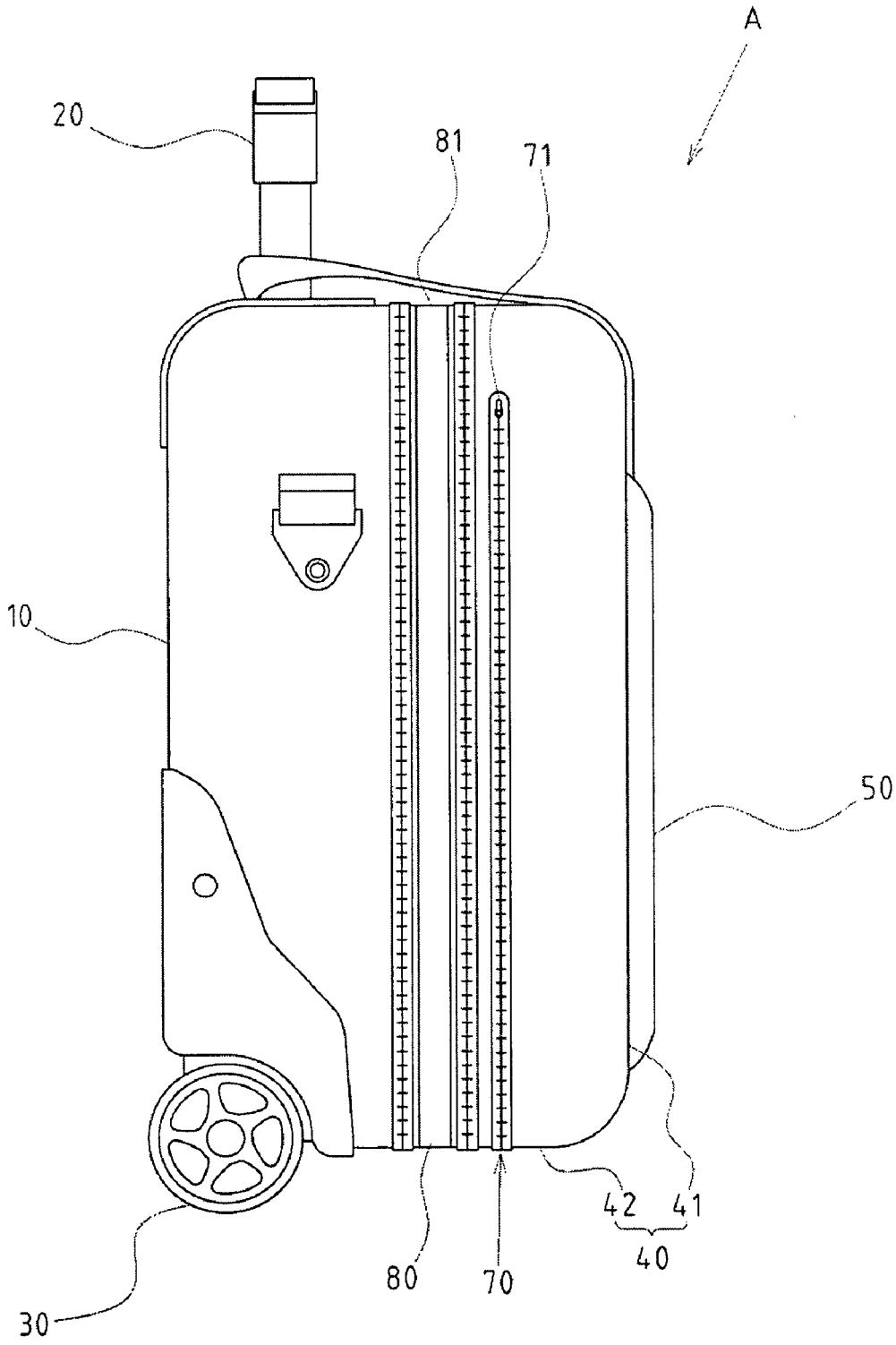
FIG. 2 is a plain sectional view of the pull-rod computer bag of the present invention.
Figure 3:
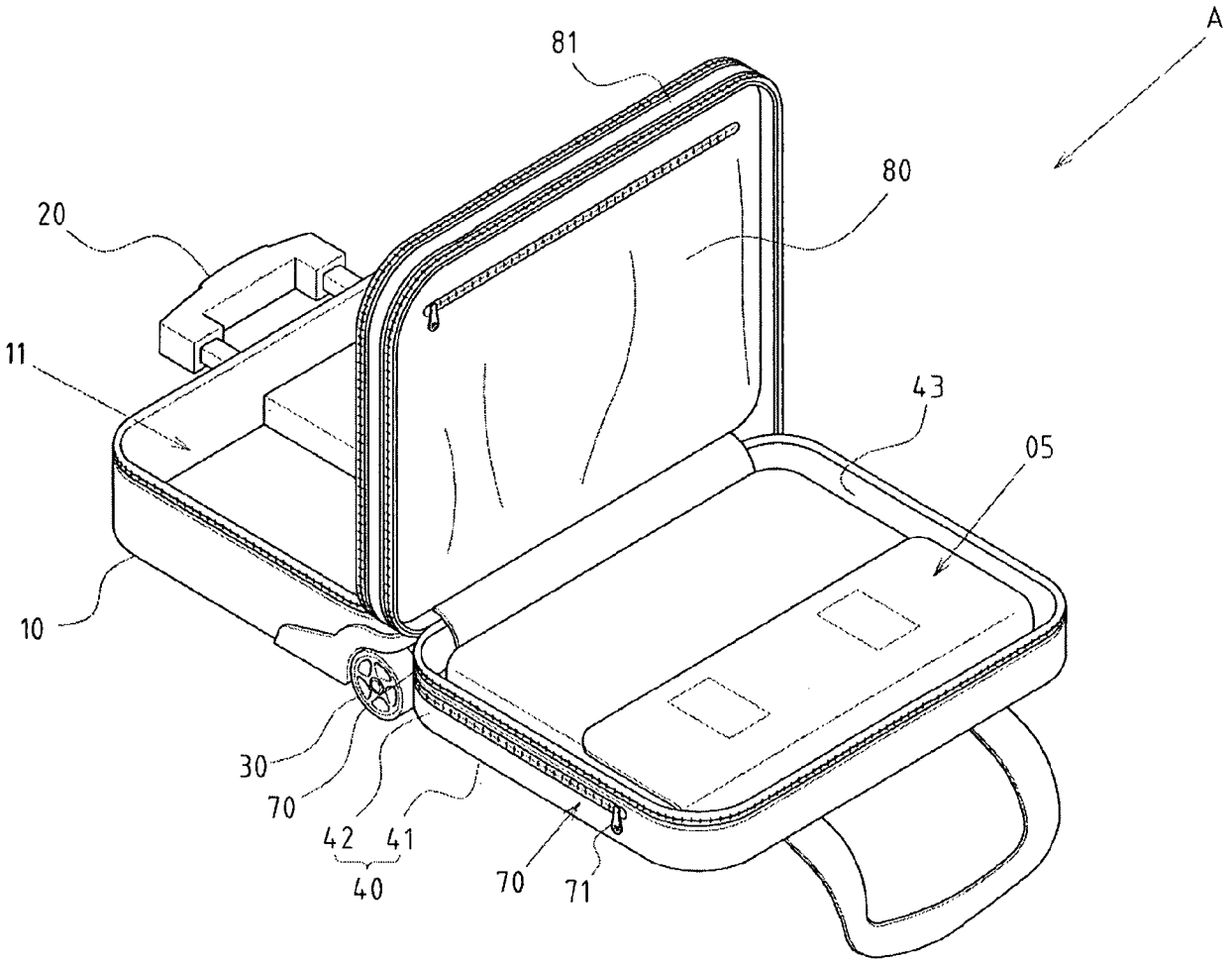
FIG. 3 is a perspective view of the pull-rod computer bag of the present invention that the housing cover, bag body and intermediate storage bag are in an open state.

FIGS. 1-3 depict preferred embodiments of a pull-rod computer bag of the present invention. The embodiments are provided only for explanatory purposes with respect to the patent claims.

The pull-rod computer bag A comprises a bag body 10, defining internally a hold space 11.

A pull rod 20 is assembled scalably onto one side of the hold space 11 of the bag body 10.

A roller set 30 is assembled at one corner of the bag body 10.

There is also a housing cover 40 with a computer hold tank 43. The housing cover 40 is laterally connected with the bag body 10, enabling them to be opened or closed. The housing cover 40 comprises a faceplate 41 and a peripheral portion 42, such that the computer hold tank 43 is formed between the faceplate 41 and peripheral portion 42, being used exclusively for accommodating a notebook computer 05.

A buffer pad 50 is assembled on the faceplate 41 of the housing cover 40. The buffer pad 50 is made of soft materials such as foamed materials or rubber.

A retractable side wall 60 is assembled onto the peripheral portion 42 of the housing cover 40, enabling the peripheral portion 42 to be expanded or reduced with respect to the area. A flexible control member 70 allows the retractable side wall 60 to be shrunk securely or expanded freely.

The retractable side wall 60 of a triangular shape has an expanded end at the joint of the housing cover 40 and bag body 10, and an reduced end at the other end. The flexible control member 70 may be a zipper 71, which is arranged along the extended direction of the retractable side wall 60. The zipper 71 is used to position the shrinking state of the retractable side wall 60 or release it into an expanding state.

Figure 4:
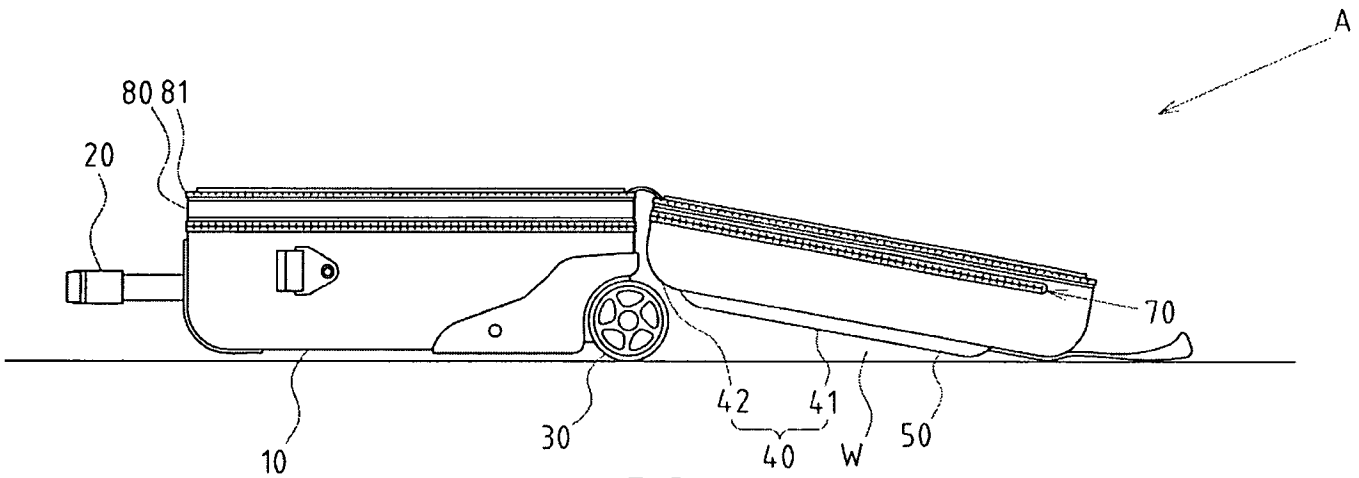
FIG. 4 is a schematic view of pull-rod computer bag of the present invention that the housing cover is opened from the bag body and placed horizontally.

Referring to FIG. 4, an intermediate storage bag 80 is arranged between the housing cover 40 and bag body 10. The intermediate storage bag 80 is circled and supported by a solid frame 81.

Figure 5:
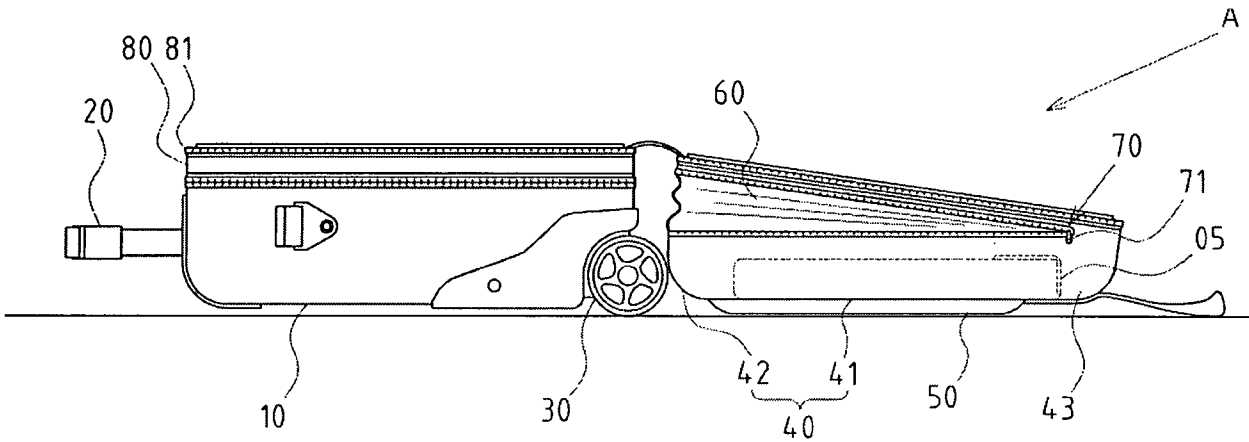
FIG. 5 is a schematic view of the present invention that the retractable side wall is expanded and the faceplate of housing cover is placed horizontally.
Figure 6:
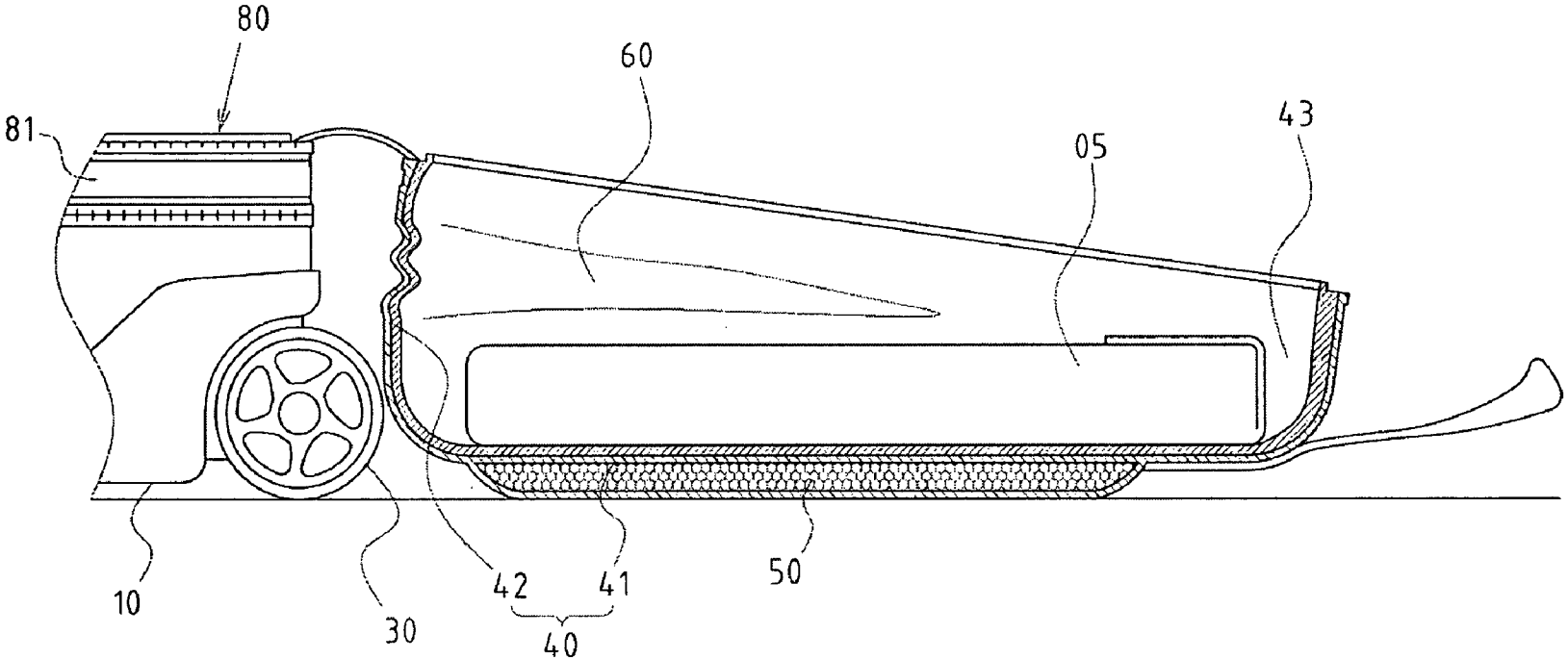
FIG. 6 is sectional view of housing cover in FIG. 5.

Based on the above-specified structures, the present invention is operated as follows:

The pull-rod computer bag A facilitates clearance through the inspection procedure at airports and ports, whereby the placement face of the luggage bag accommodating notebook computer must be horizontally placed on the conveyor belt for X-ray inspection, and also made of non-metal structure. With a view to the computer hold tank 43 of the housing cover of pull-rod computer bag A of the present invention, a buffer pad 50 is assembled laterally onto the faceplate 41 to ensure the notebook computer 05 is free from any vibration. Moreover, the faceplate 41 has no any metal structure. On the other hand, referring to FIGS. 5, 6, when the housing cover 40 is opened from the bag body 10, the faceplate 41 with a gap (indicated by W in FIG. 4) cannot be placed horizontally since the housing cover 40 is generally thinner than the bag body 10. In such a case, the retractable side wall 60 allows users to pull the zipper 71 of the flexible control member 70 and release the retractable side wall 60 into an expanding state of triangular shape, enabling the faceplate 41 of the housing cover 40 with a gap to be placed horizontally for easier X-ray inspection. It is thus seen that the pull-rod computer bag A of the present invention allows the housing cover 40 to open directly, exposing the notebook computer 05. As the faceplate 41 of the housing cover 40 is made of non-metal structure, the notebook computer 05 can be placed horizontally with a shock-proof effect, making it compliant with the provisions of the customs rules while protecting the notebook computer against any damage.

Figure 7:
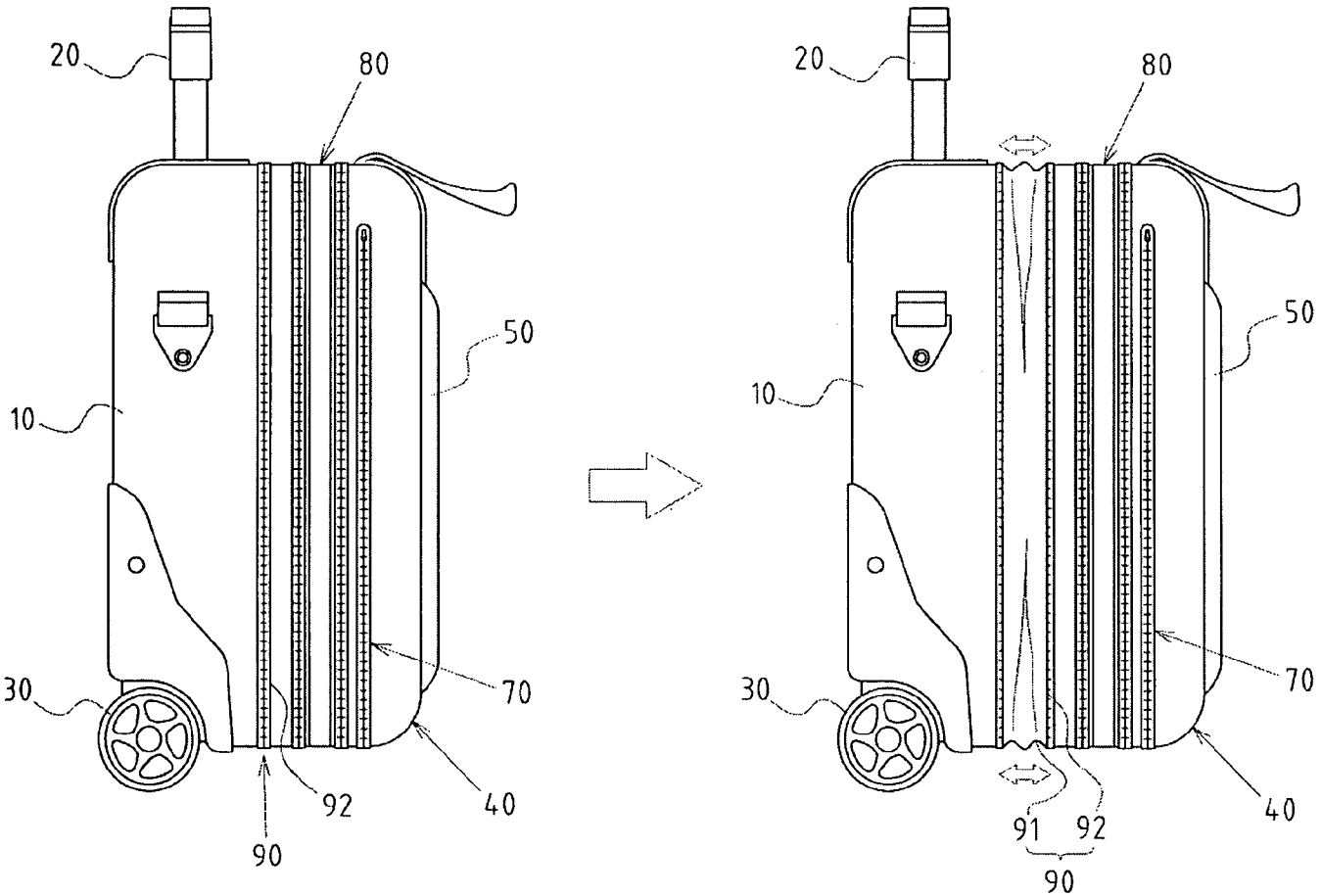
FIG. 7 is a perspective view of an application of the present invention that the bag body is additionally provided with a volume control portion.
Figure 8:
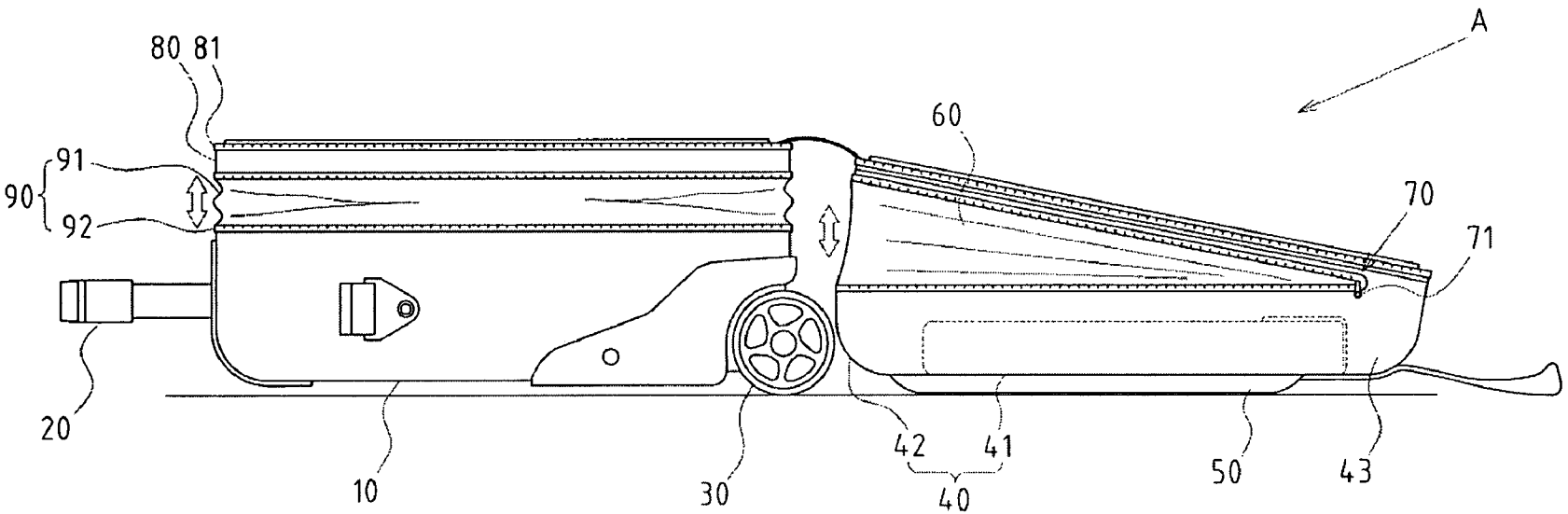
FIG. 8 is a perspective view of the present invention, showing the volume control portion expanded and the faceplate of the housing cover being still placed horizontally.

Referring also to FIG. 7, the bag body 10 can be additionally provided with a volume control portion 90, which is composed of a retractable wall 91 and a positioning zipper 92. The shrinking state (shown in left figure in FIG. 7) of the retractable wall 91 can be located by pulling the positioning zipper 92 closed or releasing the retractable wall 91 into an expanding state (shown in right figure in FIG. 7) by pulling open the positioning zipper 92. With the configuration of volume control portion 90, the volume of the bag body 10 could be adjusted flexibly depending on the number of intended objects. Referring also to FIG. 8, when the housing cover 40 is opened from the bag body 10 and placed horizontally, the faceplate 41 of the housing cover 40 can be placed horizontally by releasing the retractable side wall 60, without being affected by the volume control portion 90 of the bag body 10.

I claim:

1. A computer bag assembly comprising:

a bag body having a first section and a second section connected together by a zipper, said first and second sections defining an interior volume of said bag body, said first section having a depth greater than a depth of said second section, said first section having an outer wall, said second section having an outer wall, said first section being pivotable with respect to said second section so as to be movable between a closed orientation and an open orientation;

a pull rod slidably connected to said first section and extendable outwardly therefrom;

a roller set rotatably mounted at a corner of said first section;

a housing cover formed in said second section of said bag body, said housing cover laterally connected to said bag body, said housing cover having a non-metallic faceplate and a peripheral portion, said face plate and said peripheral portion forming a computer hold tank; and a buffer pad assembled on said faceplate of said housing cover, said buffer pad being formed of anon-metallic soft material, said second section of said bag body having a retractable side walls with a zippered section extending therealong, said zipper section having a control member suitable for allowing said retractable side walls to be in a retracted position or in an expanded position, said expanded position exposing a triangular-shaped section, said triangular-shaped section being perpendicular to a hinge between said first section and said second section such that said outer wall of said second section is generally coplanar with said outer wall of said first section when said bag body is in said open orientation.

2. The computer bag assembly of claim 1, said buffer pad being of foamed materials.

3. The computer bag associated of claim 1, said triangular-shaped section having an expanded portion adjacent said roller set when said bag body is in said open orientation, said control member being a zipper.

4. The computer bag associated of claim 1, further comprising:

an intermediate storage bag positioned in said bag body, said intermediate storage bag having a solid frame extending therearound.

5. The computer bag associated of claim 1, said first section of said bag body having a volume control portion, said volume control portion having a retractable wall and a positioning zipper, said positioning zipper being movable so as to cause said retractable wall to be extended or retracted.

* * * * *